US006334658B1

(12) United States Patent
Suzuki

(10) Patent No.: US 6,334,658 B1
(45) Date of Patent: Jan. 1, 2002

(54) INK-JET PRINTER

(75) Inventor: Shogo Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/186,289

(22) Filed: Nov. 5, 1998

(30) Foreign Application Priority Data

Nov. 6, 1997 (JP) ..... 9-304558

(51) Int. Cl.[7] ..... B41J 2/195; B41J 29/393
(52) U.S. Cl. ..... 347/7; 347/19
(58) Field of Search ..... 347/7, 19

(56) References Cited

U.S. PATENT DOCUMENTS 5,068,806 A * 11/1991 Gatten ..... 395/113
5,519,418 A 5/1996 Nishikawa et al. ..... 347/19
5,757,390 A * 5/1998 Gragg et al. ..... 347/7
5,841,448 A * 11/1998 Moriyama et al. ..... 347/19
5,997,121 A * 12/1999 Altfather et al. ..... 347/7
6,151,039 A * 11/2000 Hmelar et al. ..... 347/7

* cited by examiner

*Primary Examiner*—John Barlow
*Assistant Examiner*—Alfred Dudding
(74) *Attorney, Agent, or Firm*—Oliff & Berridge PLC

(57) ABSTRACT

The invention provides an ink-jet printer for enabling precise and automatic detection of an ink jetting failure in an ink-jet head. When ink in an ink tank decreases up to an ink supplement level, a fixed quantity of ink in the shape of a pellet is supplied the number of jetted ink droplets corresponding to print data and the like, are counted, and the printing operation is executed. When ink again decreases up to quantity for ink to be supplemented, the calculated ink consumed quantity calculated based upon the counted number of jetted ink droplets and the quantity of ink in the ink pellets, are compared. If both are not equal, it is determined that an ink jetting failure has occurred. Then, after a maintenance operation is executed, ink is again supplied and the printing operation is continued.

19 Claims, 12 Drawing Sheets

INK-JET PRINTER

BACKGROUND OF THE INVENTION

1. Field of Invention

The invention relates to an ink-jet printer for jetting ink on a recorded medium from an ink-jet head to form an image, and in particular, relates to an ink-jet printer which can detect that an ink jetting failure has occurred in the ink-jet head.

2. Description of Prior Art

Heretofore, a conventional ink-jet printer cannot automatically detect an ink jetting failure, such that when a user finds the omission (a so-called defect) of a printed image formed on a recorded medium, the user must determine that an ink jetting failure has occurred. When an ink jetting failure occurs, a user cleans an ink-jet head with a swab, etc., to solve the ink jetting failure. An ink-jet printer provided with a maintenance device for cleaning an ink jetted path in an ink-jet head has been recently developed. For the maintenance device, a purging device in which ink in the above ink jetted path is forcedly discharged together with bubbles and dust, and the nozzle face is wiped to remove the ink and dust around the nozzle, etc., has been devised. When an ink jetting failure occurs, the above ink-jet head failure can be solved by cleaning the above ink jetted path using the above maintenance device.

However, as a conventional type ink-jet printer cannot detect an ink jetting failure until a user finds the omission on a printed image formed on a recorded medium, a large quantity of printing error may be caused. A plan that when an ink jetting failure may occur, the above ink jetted path is cleaned by the maintenance device at a predetermined time, has also been devised. However, in this case, maintenance is required to be frequently executed sufficiently in advance. During maintenance, the printing operation is required to be interrupted and during purging and the like, ink is consumed. Therefore, in this case, valuable ink is consumed by frequent maintenance and the time required for printing is also extended.

SUMMARY OF THE INVENTION

The invention provides an ink-jet printer for enabling precisely and automatically detecting an ink jetting failure in an ink-jet head. In particular, the invention automatically solves an ink jetting failure when the ink jetting failure occurs, by automatically supplementing the ink supply when the ink supply decreases, and reducing the load related to processing.

A printer according to the invention is based upon an ink-jet printer provided with an ink tank for storing ink, an ink-jet head for jetting ink in the ink tank onto a recorded medium according to a driving signal, a detector for detecting the consumed quantity of ink in the ink tank, a calculation unit for calculating the consumed quantity of ink in the ink tank according to a driving signal, and a determination unit for comparing the consumed quantity of ink calculated by the calculation unit and that detected by the detector and determining that an ink jetting failure has occurred in the ink-jet head if difference between both exceeds predetermined quantity.

In the invention as described above, an ink-jet head jets ink stored in an ink tank onto a recorded medium according to a driving signal. The detector detects the consumed quantity of ink in the ink tank. As an ink-jet head jets ink according to a driving signal, the consumed quantity of ink in the ink tank normally has a relation to the driving signal. The calculation unit calculates the consumed quantity of ink in the ink tank according to the driving signal. The determination unit compares the consumed quantity of ink calculated by the calculation unit and that detected by the detector and determines that an ink jetting failure has occurred in the ink-jet head if difference between both exceeds a predetermined quantity. That is, as ink is not jetted according to a driving signal when an ink jetting failure occurs, the difference between the consumed quantity of each ink calculated and detected is determined. That is, if an ink jetting failure continues for a fixed period, the counted value of the consumed quantity gradually comes off. When such a situation occurs, the determination unit determines that an ink jetting failure has occurred.

Therefore, according to the invention, an ink jetting failure in an ink-jet head can be precisely and automatically detected. According to the detection, a warning can be given and printing can be also halted. Therefore, even if a user fails to find the ink jetting failure, a large quantity of printing error can be satisfactorily prevented from occurring.

If maintenance is executed as necessary based upon the result of the determination by the determination unit according to the invention, the frequency of maintenance to be executed is appropriately set, and ink and printing time can be satisfactorily prevented from being wasted. As the time to execute maintenance according to the result of the determination, the time of maintenance may be also set and stored as the time when an ink jetting failure occurs, a total quantity of ink is jetted, a total time that an inkjet head is driven, and the like, before an ink jetting failure occurs since the last maintenance. The time of maintenance may be also set to a time immediately before the jetted quantity and the driven time occurs. In the case of the latter, the occurrence of an ink jetting failure can be prevented beforehand and the occurrence of a printing error can be more satisfactorily inhibited.

Further, the invention is characterized in that a maintenance unit for cleaning an ink jetted path in an ink-jet head and a maintenance controller for cleaning the ink jetted path by the maintenance unit when the above determination unit determines that an ink jetting failure occurs, are further provided.

According to the invention, when the determination unit determines that an ink jetting failure occurs, the maintenance controller instructs the maintenance unit to clean an ink jetted path in an ink-jet head. Therefore, according to the invention, when an ink jetting failure occurs, it can be automatically solved. Also, according to the invention, as maintenance (cleaning an ink jetted path) is executed when an ink jetting failure occurs, the frequency in which maintenance is executed can be minimized. Therefore, ink and printing time can be prevented from being wasted.

Further, the invention is characterized in that the above detector can detect when ink in an ink tank decreases and ink is required to be supplemented. An ink supply unit for supplying a predetermined quantity of ink in an ink tank and supply controller for instructing the above ink supply unit to supply ink when the detector detects that ink is required to be supplemented, may be further provided. When the detector detects that ink is required to be supplemented, the supply controller supplies a predetermined quantity of ink to an ink tank via the ink supply unit. Therefore, according to the invention, ink can be automatically supplemented when the ink decreases.

The ink supply unit according to the invention supplies a predetermined quantity of ink to an ink tank. Therefore, if the detector detects that ink is required to be supplemented, the ink supply unit supplies ink and afterward, the detector detects that ink is required to be supplemented again, the consumed quantity of ink is the above predetermined quantity. Therefore, the detector according to the invention can detect the consumed quantity of ink even if the detector only detects that ink is required to be supplemented. Therefore, in this case, the structure of the ink-jet printer can be extremely simplified and the manufacturing cost can be reduced satisfactorily.

Further, the invention is characterized in that the detector can detect that ink in an ink tank decreases up to a first reference value and ink in the ink tank decreases up to a second reference value different from the first reference value. Therefore, when the quantity of ink in an ink tank is between both reference values, the consumed quantity of ink can be readily detected. In this case, the consumed quantity of ink in a short period can be detected, compared with a case that the detector only detects that ink is required to be supplemented. Therefore, the consumed quantity of ink calculated by the calculation unit may also correspond to a short period. Therefore, according to the invention, the load related to calculation processing by the calculation unit can be reduced. In the invention, the supplied quantity of ink may be arbitrary.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

Figure 1:
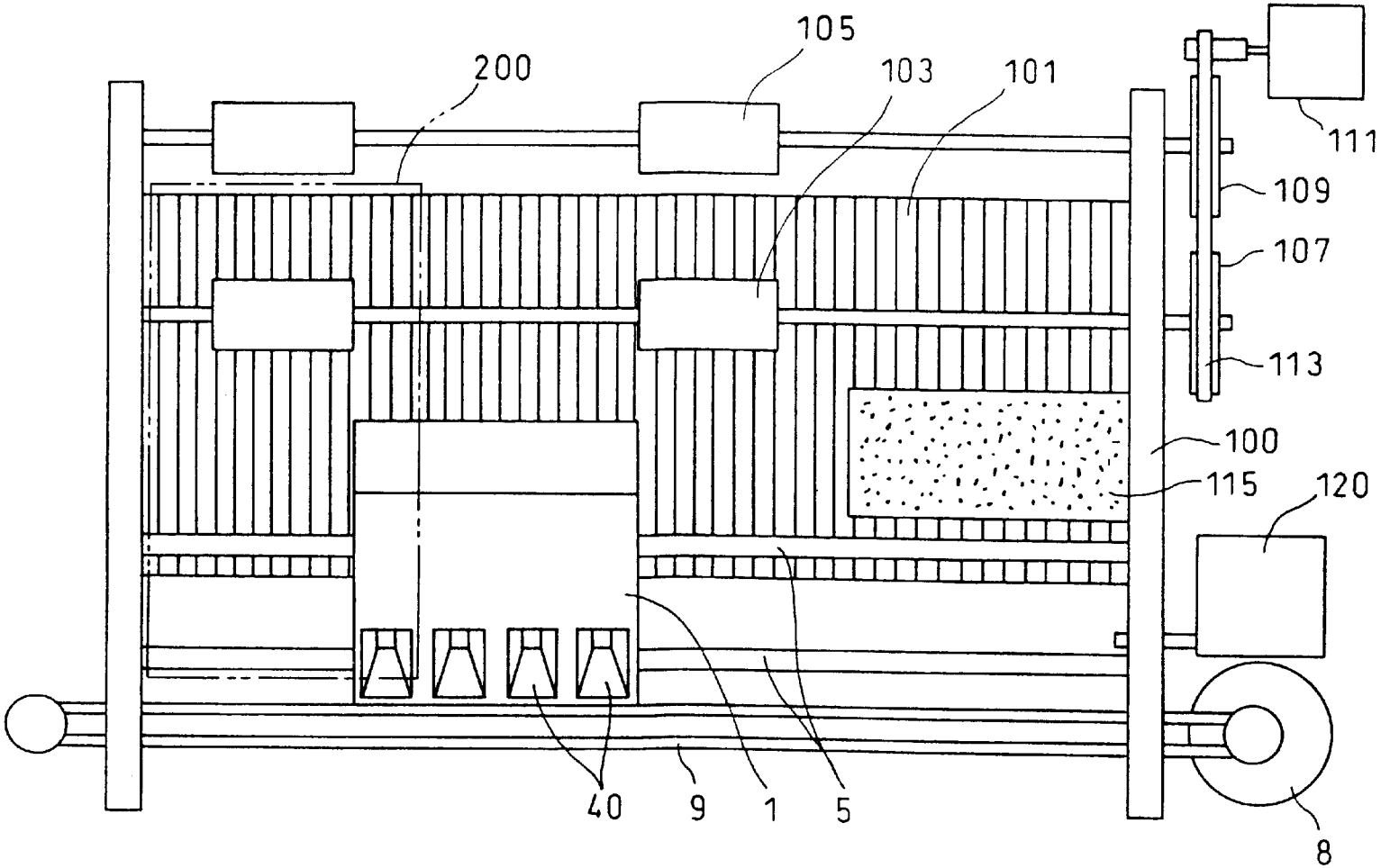
FIG. 1 shows an ink-jet printer to which the invention is applied.

Next, referring to the drawings, embodiments of the invention will be described. FIG. 1 shows an example of an ink-jet printer to which the present invention is applied. An ink-jet printer in this embodiment is a so-called hot melt ink-jet printer for melting solid ink thermically and jetting it.

As shown in FIG. 1, a head (an ink-jet head) 1 of an ink-jet printer in this embodiment is mounted on a carriage 3 (shown in FIG. 6) so that the carriage can be moved along a guide shaft 5. The head 1 jets ink onto a recorded medium carried in the vicinity of the left side and moved into a printing range, and is moved to a maintenance area in the vicinity of the right end of the guide shaft 5 before or after printing or at a predetermined time when a maintenance operation described below is applied to the head. The carriage 3 is connected to a carriage motor 8 via a belt 9 and is a well-known type moved along the guide shaft 5 as the carriage motor 8 is rotated.

The top face of a frame 100 for supporting the head 1 via the guide shaft 5, functions as a guide face 101 for guiding recording paper. Feed rollers 103 and 105 are arranged on the guide face 101. Pulleys 107 and 109 are respectively fixed coaxially to each feed roller 103 and 105 and the driving force of a feed motor 111 is transmitted to the pulleys 107 and 109 via a belt 113. Therefore, recording paper can be carried in a direction perpendicular to the guide shaft 5 along the guide face 101. A rubber pad 115 is arranged in a position opposite to the nozzle face 36 (shown in FIG. 4) of the head 1 in the above maintenance area so that the rubber pad can be pressed or separated on/from the nozzle face 36 by a pad driving motor 117 (shown in FIG. 8). Further, a pump 120 for executing purging described below is arranged outside the frame 100 on the side of the maintenance area with the carriage motor 8 and the feed motor 111.

Figure 2:
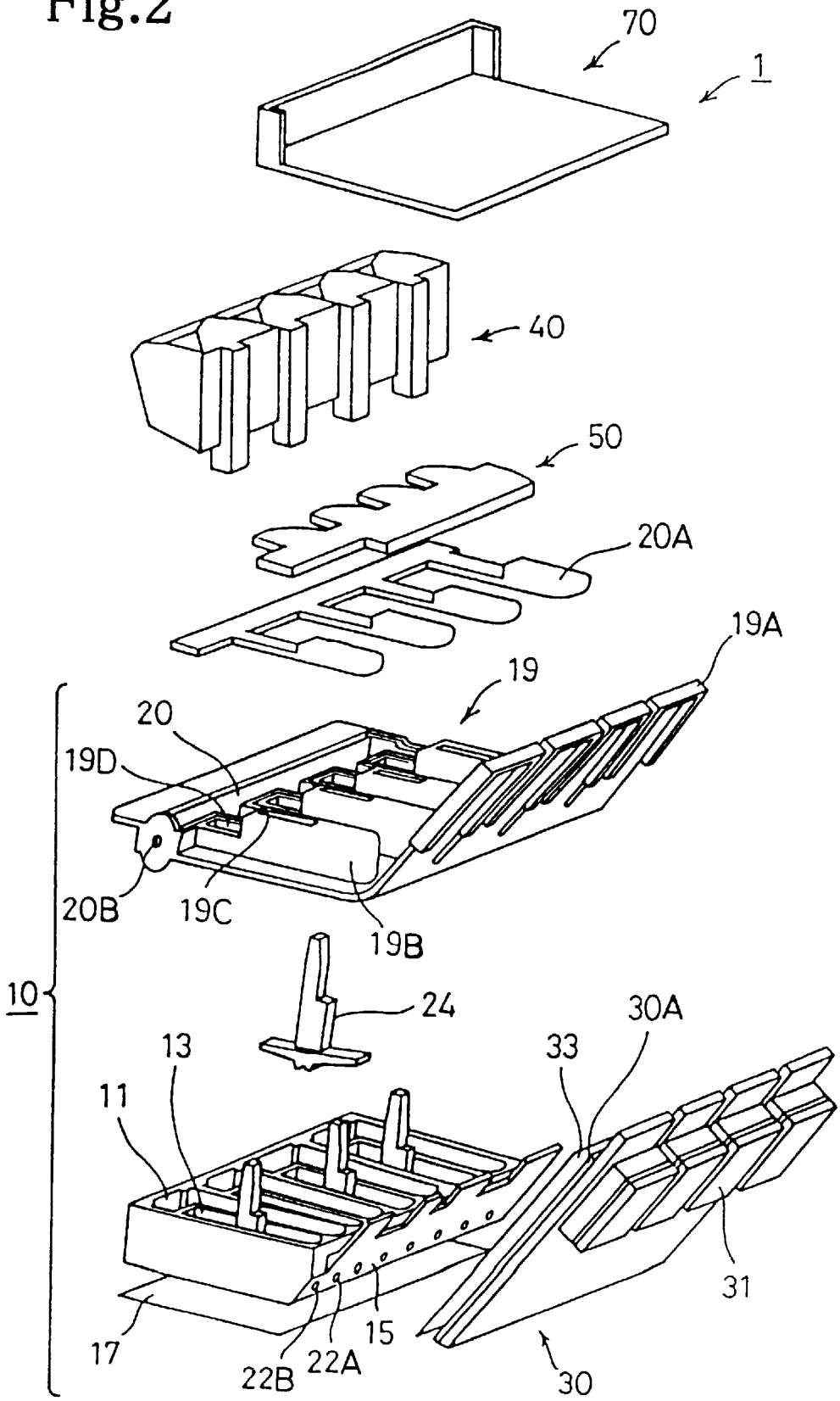
FIG. 2 is an exploded perspective view showing the head of the printer.
Figure 3:
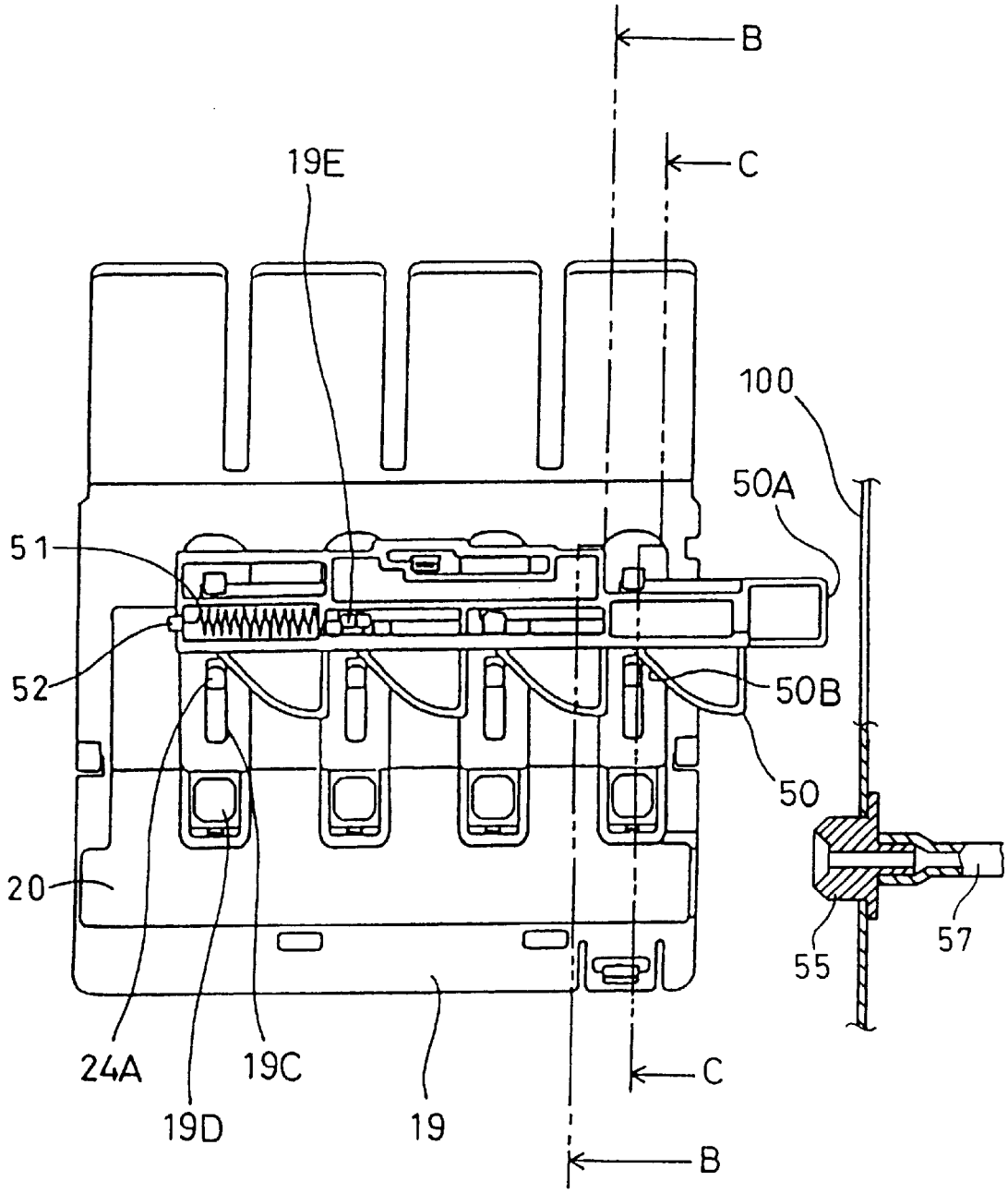
FIG. 3 is a top view showing the ink tank of the head.
Figure 4:
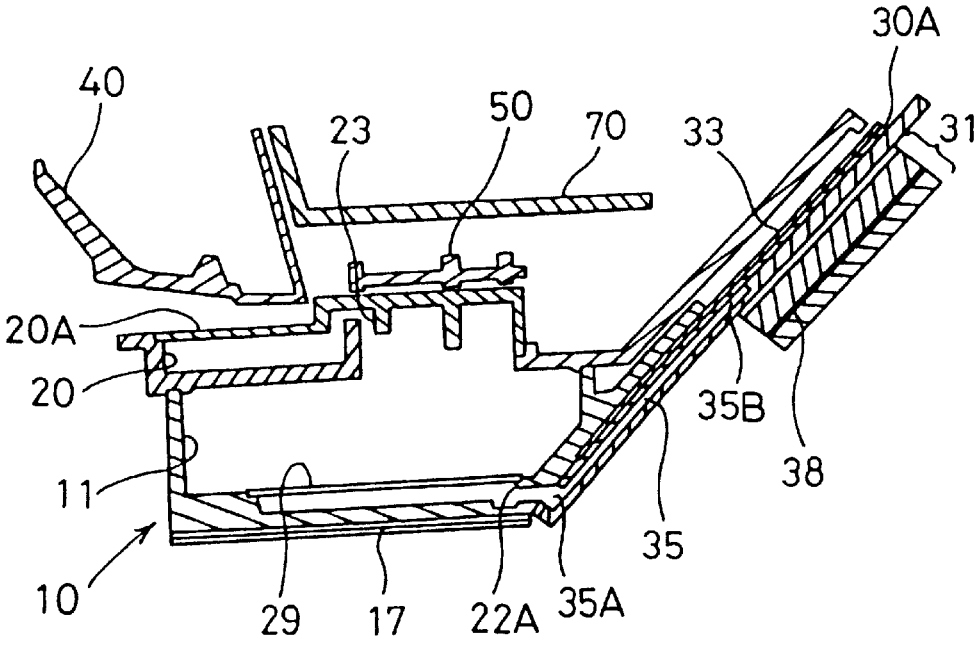
FIGS. 4(A) and 4(B) are sectional views viewed along lines B—B and C—C in FIG. 3 showing the ink tank.
Figure 4:
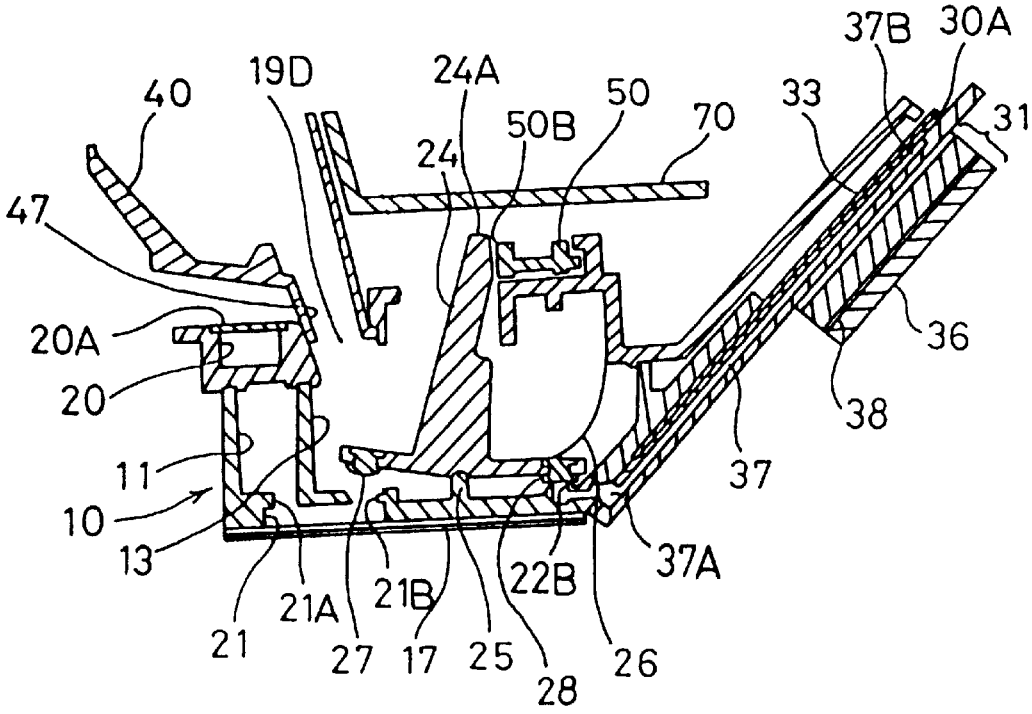

Next, referring to FIGS. 2–4, the structure of the head 1 will be described. FIG. 2 is an exploded perspective view showing the head 1, FIG. 3 is a top view showing an ink tank 10 of the head 1 and FIGS. 4(A) and 4(B) are sectional views viewed along lines B—B and C—C in FIG. 3. For the structure of the head 1, refer to Japanese published unexamined patent application No. Hei 10-146959.

As shown in FIG. 2, the head 1 is provided with the ink tank 10, a front panel 30, a melting tank 40, a cam 50 and a control panel stage 70. The ink tank 10 is provided with a tilted front part 15 for attaching the front panel 30, four sets of main chambers 11 and deputy chambers 13 for color output (black, cyan, magenta and yellow) for storing hot melt ink (hereinafter, it may be called only ink), an ink tank upper cover 19 and an ink tank heater 17 attached on the rear surface of the ink tank 10 and further, as shown in FIG. 4(B), a communicating passage 21 open downward is provided on the rear side of the bottom of each main chamber 11 and each deputy chamber 13 of the ink tank 10.

The main chamber 11 is in the shape of a letter L (as shown in FIG. 2) when viewed from the top and is provided with a main chamber inlet 21A (shown in FIG. 4(B)) leading to the communicating passage 21, a main chamber outlet 22A (also shown in FIG. 4(A)) leading to the front panel 30 and a filter 29 (shown in FIG. 4(A)). The filter 29 is produced by pressing after fibers made of stainless steel are sintered and is changed to a shape of paper, each fiber is complicatedly bent and overlapped and is provided with a passage with a three dimensional structure (for example, Tomy firec SS (trademark) manufactured by Tomoegawa Seishijo).

The deputy chamber 13 is provided with a deputy chamber outlet 21B leading to the communicating passage 21, a deputy chamber inlet 22B leading to the front panel 30 and a valve opening/closing lever 24 approximately in the shape of a reverse T for opening the other when either the deputy chamber outlet 21B or the deputy chamber inlet 22B is closed, as shown in FIGS. 2 and 4(B).

The valve opening/closing lever 24 is cast in an aluminum alloy using a die and is attached with a lever pedestal 25 provided between the deputy chamber outlet 21B and the deputy chamber inlet 22B as a supporting point in a state in which the valve opening/closing lever can be swung, as shown in FIG. 4(B). The valve opening/closing lever 24 is provided with pressure valves 27 and 28 and is normally kept in a state in which the pressure valve 28 seals the deputy chamber inlet 22B by being pressed by a plate spring 26. The pressure face of the pressure valve 27 is spherical, the edge of the deputy chamber outlet 21B corresponding to the pressure face is tapered. The pressure face of the pressure valve 28 is flat and the edge of the deputy chamber inlet 22B corresponding to it is circularly protruded. The pressure valves 27 and 28 are made of silicone rubber, with a Shore hardness of approximately 40° and a heat resistance temperature of approximately 200° C.

As shown in FIG. 2, the ink tank upper cover 19 is provided with a front panel cover 19A fitted to the shape of the front panel 30, a deputy chamber cover 19B for covering the deputy chamber 13, a long hole 19C for exposing the upper end 24A of the valve opening/closing lever 24, an ink input port 19D for supplying hot melt ink from the melting tank 40 to the deputy chamber 13, an air chamber 20 for delivering compressed air to each main chamber 11 from the pump 120 shown in FIG. 1, a through hole 20B open to the side of the ink tank 10 from the air chamber 20 and an air chamber cover 20A for sealing the air chamber 20. The air chamber 20 of the ink tank upper cover 19 is provided with a through hole 23 leading to the main chamber 11 as shown in FIG. 4(A).

Figure 5:
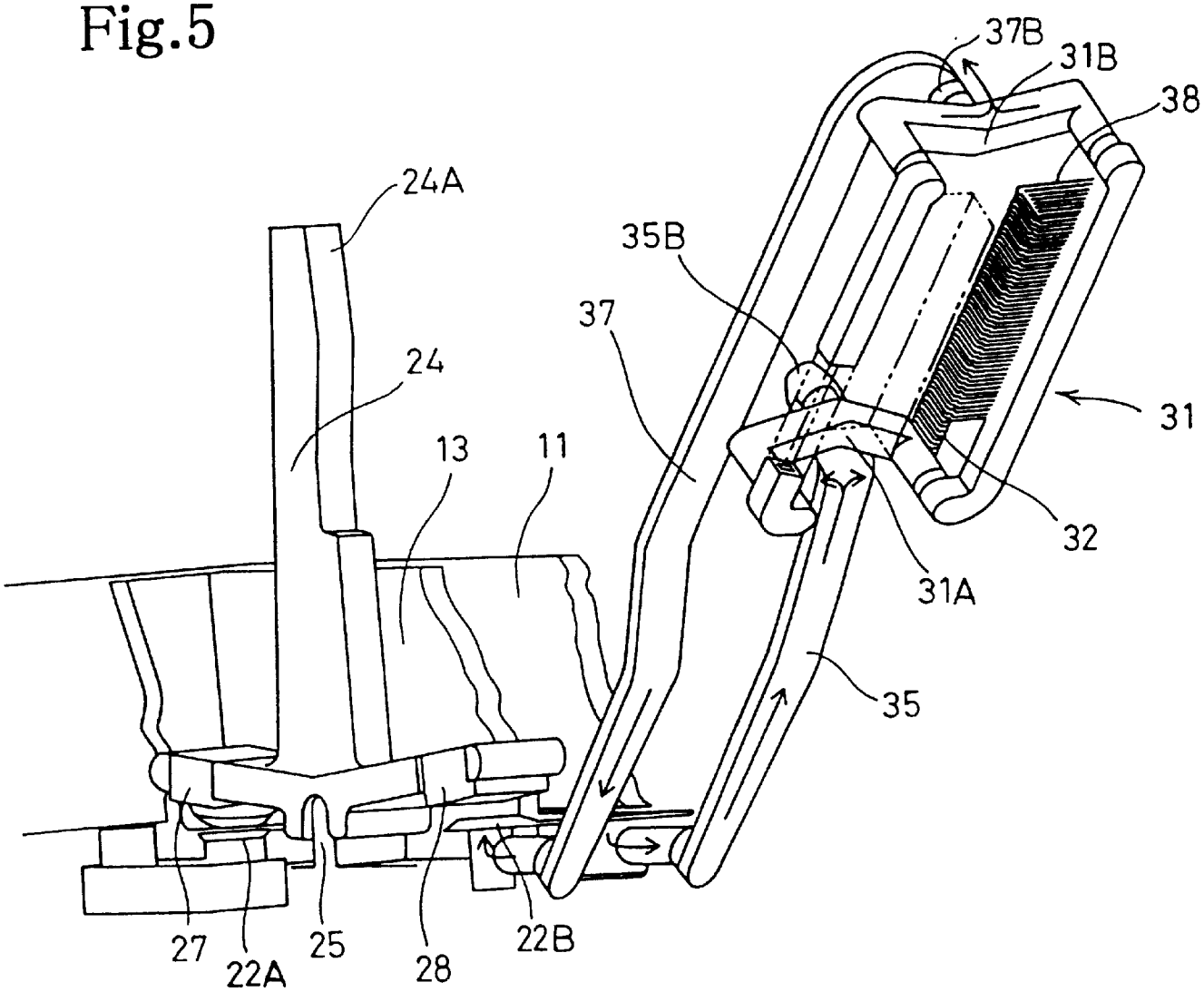
FIG. 5 shows the purging operation of the head.

As shown in FIG. 2, the front panel 30 is provided with four nozzle heads 31 on the front surface and on the rear surface, an approach route 35 shown in FIGS. 4(A) and 5 leading from each main chamber 11 to each nozzle head 31 and a return route 37 shown in FIGS. 4(B) and 5 leading from each nozzle head 31 to each deputy chamber 13, are formed. Further, as shown in FIGS. 2 and 4, a cover panel 30A is attached to the rear surface of the front panel 30 so that the cover panel 30A covers the approach route 35 and the return route 37 and a front panel heater 33 is attached to the rear surface of the cover panel 30A. As shown in FIGS. 4(A) and 4(B), an approach route inlet 35A from each main chamber 11 to each approach route 35, an approach route outlet 35B from each approach route 35 to each nozzle head 31, a return route inlet 37B from each nozzle head 31 to each return route 37 and a return route outlet 37A from each return route 37 to each deputy chamber 13, are respectively provided.

The nozzle head 31 is provided with a piezoelectric-crystal element 38 and jets ink supplied via the approach route outlet 35B according to the change of the volume of the piezoelectric-crystal element 38. Ink supplied to the nozzle head 31 can be circulated to the deputy chamber 13 via the return route inlet 37B and the return route 37. That is, as shown by an arrow in FIG. 5, ink reaches a nozzle 32 via the approach route 35, the approach route outlet 35B and a lower branch point 31A and further, can be circulated to the deputy chamber 13 via an upper branch point 31B, the return route inlet 37B and the return route 37. For the nozzle 32, 128 minute jets are arranged in two rows by 64 pieces and ink is jetted onto recording paper by pressurizing ink according to the minute change of the volume of the piezoelectric-crystal element 38.

The cam 50 is attached on the ink tank upper cover 19 in the right and left directions in FIG. 3 in a state in which the cam can be slid and is protruded right from the ink tank upper cover 19 in the vicinity of a contact face 50A. The cam 50 is provided with four cam faces 50B and a state in which the cam face 50B does not touch the upper end 24A of the valve opening/closing lever 24, is normally kept by being pressed by a spring 51 provided between a projection 52 provided at the left end of the cam 50 and a projection 19E provided to the ink tank upper cover 19.

Figure 7:
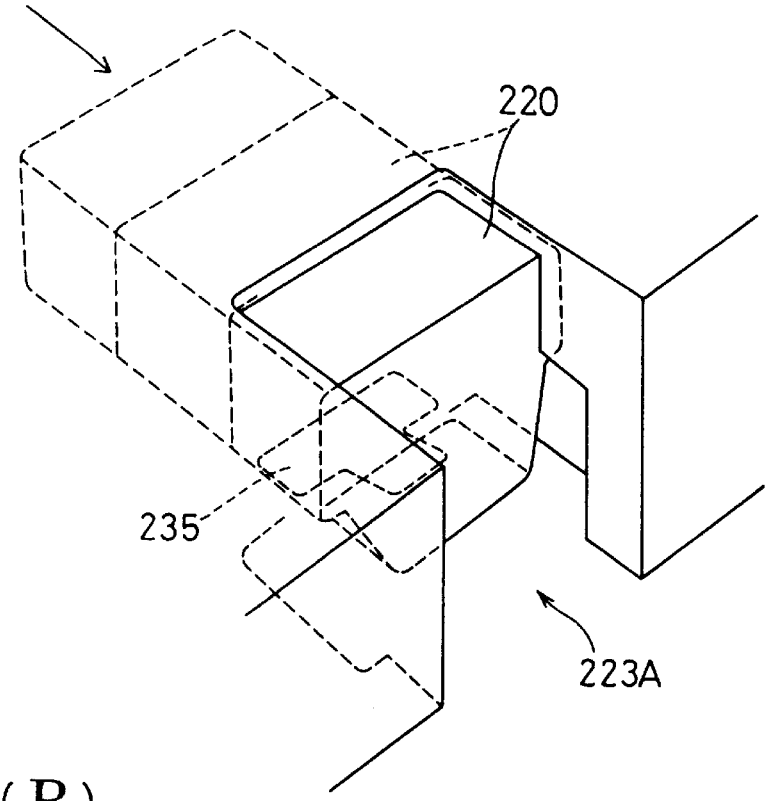
FIGS. 7(A) and 7(B) are perspective drawings showing the vicinity of the ink outlet of the ink feeder.
Figure 7:
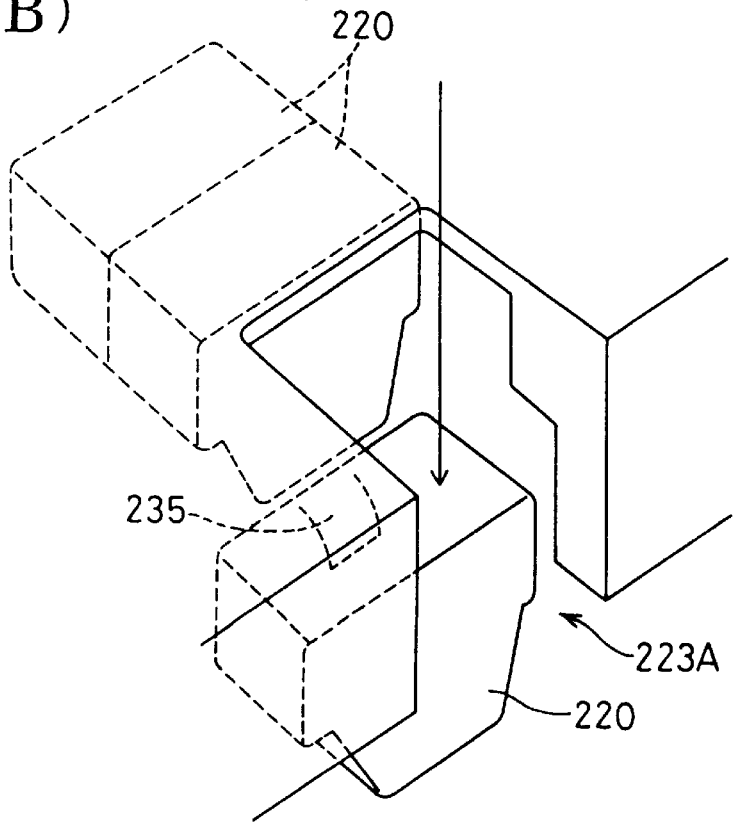

As shown in FIG. 2, the melting tank 40 is divided into four chambers for the colors of black, cyan, magenta and yellow. Each chamber is in the shape of a box the upper part of which is open so that an ink pellet 220 (shown in FIG. 7) as solid ink can be thrown into each chamber. As shown in FIG. 4(B), a passage 47 for leading melted ink to the deputy chamber 13 is formed in the lower part of each chamber of the melting tank 40.

Figure 6:
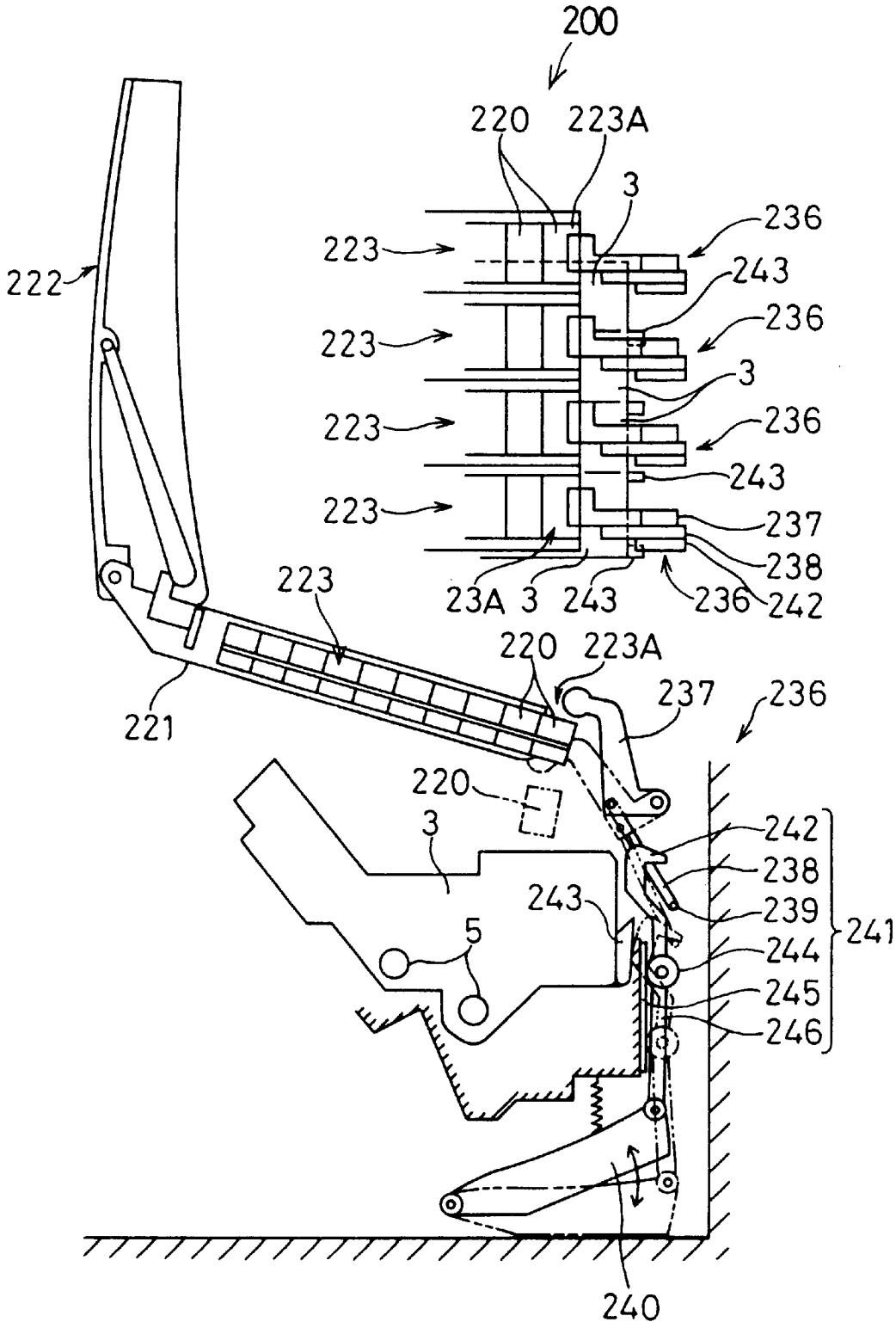
FIG. 6 is a side view and a top view showing the ink feeder of the printer.

The ink pellet 220 is supplied to the melting tank 40 from an ink feeder 200, as shown in FIG. 6. The melting tank 40 is provided with a heater, the ink pellet 220 is melted by the heater and supplied to the deputy chamber 13 of the ink tank 10 via the passage 47. Further, the control panel stage 70 is provided with a control board and attached to the upper part of the head 1.

In the head 1 as described above, if the piezoelectric-crystal element 38 is driven according to print data, and the like, as described above after the ink pellet 220 is kept in a melted state by driving various heaters 17, 33, and the like, ink can be jetted. When the head 1 is moved to the above maintenance area, the purging can be executed as follows.

Purging operation for pressurizing ink in the front panel 30 and the nozzle head 31 from the side of the main chamber 11, involves delivering bubbles and dust in ink which respectively cause a failure of jetting in the nozzle 32, outside from the nozzle face 36. The bubbles and dust in ink in the front panel 30 are then delivered to the deputy chamber 13 together with ink and the respective nozzle and the front panel is filled with clean ink filtered by the filter 29. Bubbles are mixed in ink when the temperature of the head 1 lowers and ink is solidified after a power source is turned off and ink is melted after the power source is turned on again. Dust may enter from the nozzle 32.

When the head 1 is moved to the maintenance area, the contact face 50A of the cam 50 is pressed upon the frame 100, as shown in FIG. 3 and a hollow cylindrical cap 55 provided to the frame 100 covers the through hole 20B. The cam 50 is slid relatively left on the ink tank upper cover 19 and the cam face 50B presses the upper end 24A of the valve opening/closing lever 24 and the cam face 50B presses and moves the upper end 24A of the valve opening/closing lever 24 downward in FIG. 3. Therefore, the valve opening/closing lever 24 is swung based upon the lever pedestal 25 as a supporting point, contact between the pressure valve 28 and the deputy chamber inlet 22B is released, when the valve opening/closing lever is further swung, the pressure valve 27 and the deputy chamber outlet 21B come in contact, the deputy chamber inlet 22B is released and the deputy chamber outlet 21B is sealed.

At this time, if compressed air is delivered from the pump 120 (shown in FIG. 1) via a pipe 57 connected to a hollow part of the cap 55 because the cap 55 covers the through hole 20B, bubbles can be pushed out as follows: That is, atmospheric pressure in the main chamber 11 is increased by delivering compressed air. As the deputy chamber outlet 21B is sealed and the deputy chamber inlet 22B is released, bubbles and dust in the ink are filtered by the filter 29 via the main chamber 11 and afterward, ink reaches the nozzle head 31 via the main chamber outlet 22A, the approach route inlet 35A, the approach route 35 and the approach route outlet 35B. Next, the above ink is divided into a path in which the ink is discharged outside (jetted) from the nozzle 32 and a path in which the ink is directed on the side of the return route inlet 37B. If the nozzle face 36 is open, the respective flow rates are determined according to the passage resistance of the approach route 35, the return route 37 and the nozzle 32. Ink which flows in the path on the side of the return route inlet 37B is carried to the deputy chamber 13 via the return route 37, the return route outlet 37A and the deputy chamber inlet 22B. Hereby, ink including bubbles in the approach route 35, the nozzle 32 and the return route 37, is replaced with clean ink.

Afterward, when the head 1 is moved left and the contact face 50A is separated from the frame 100, the upper end 24A of the valve opening/closing lever 24 is not pressed by the cam face 50B. The valve opening/closing lever 24 is swung based upon the lever pedestal 25 as a supporting point by pressure by the plate spring 26, the deputy chamber inlet 22B is sealed and the deputy chamber outlet 21B is released. Hereby, ink forcedly carried into the deputy chamber 13 in purging, is returned to the main chamber 11 via the communicating passage 21 and the respective levels of the main chamber 11 and the deputy chamber 13 can be equalized.

The head 1 in this embodiment is designed so that the passage resistance of all the nozzles is smaller than the passage resistance of the return route 37. For a method of setting passage resistance, the higher the temperature of the ink, the more flowability is enhanced. The passage resistance of the nozzle 32 and the return route 37 can be set so that the passage resistance of the nozzle 32 is low and the passage resistance of the return route 37 is high by adjusting so that the temperature of ink in the nozzle is high and the temperature of ink in the return route 37 is low. The passage resistance may be also set based upon the cross-sectional area of a passage and the shape of a passage. Therefore, if the nozzle face 36 is open, most of ink carried to the approach route 35 is discharged outside from the nozzle 32. If the rubber pad 115 is pressed on the nozzle face 36, the aperture of the nozzle 32 is sealed to prevent ink from being discharged from the nozzle 32. In this case, most of ink carried to the approach route 35 is circulated via the return route 37. Therefore, if purging is executed twice by switching the pressure/release of the rubber pad 115, ink including bubbles in the approach route 35, the nozzle 32 and the return route 37, can be effectively replaced with clean ink.

Next, the structure of the above mentioned ink feeder 200 and the control board of the control panel stage 70 will be described. FIG. 6 is a side view and a top view showing the structure of the ink feeder 200. As shown in FIG. 6, the ink feeder 200 is provided with a body 221 and a transparent cover 222 provided to the body 221 so that the transparent cover 222 can be opened or closed. A housing groove part 223 for housing the ink pellet 220, is formed in the body 221. The housing groove parts 223 are arranged corresponding to each color of black, cyan, magenta and yellow in parallel and the ink pellet 220 of each color housed there is pressed in the direction of the ejection part 223A by a pressing member (not shown), such as a spring.

As shown in FIG. 7(A), the ejection part 223A is open between the upper surface and the lower surface. A pellet supporting piece 235 one end of which is fixed to the bottom of the housing groove part 223, is provided to the lower surface of the ejection part 223A and the pellet supporting piece 235 is structured so that the ink pellet 220 moved to the ejection part 223A is held by touching the pellet supporting piece to the lower surface of the ink pellet 220 and supporting the ink pellet 220. The ink pellet 220 held in the ejection part 223A is pressed downward by an ejecting mechanism 236 shown in FIG. 6, and ejected, bending the pellet supporting piece 235 as shown in FIG. 7(B).

As shown in FIG. 6, the ejecting mechanism 236 is provided to each housing groove part 223 and is provided with a first turning member 237 for pressing the upper surface of the ink pellet 220 downward in turning. The first turning member 237 can be coupled to a second turning member 240 via a turning control mechanism 241 and the second turning member 240 is structured so that it is turned vertically (in a direction shown by an arrow) via a gear mechanism (not shown) by the feed motor 111 shown in FIG. 1.

The turning control mechanism 241 is provided with a first coupling member 238 one end of which is coupled to the first turning member 237 so that the first turning member can be turned, a fitting member 239 provided on the side of a free end of the first coupling member 238 and a key member 242 which can be fitted to the fitting member 239. The side of the free end of the key member 242 is formed in the shape of a key so that it is fitted to the fitting member 239 and the end of the key is designed so that the key does not come in contact with the fitting member 239 only by moving the key member 242 vertically.

In the meantime, a pinion member 244 is provided to the side of the fixed end of the key member 242 so that the pinion member can be rotated and the pinion member 244 supports the free end of the key member 242 so that the key member can be turned sideways. The pinion member 244 is engaged with a rack member 245, and the pinion member 244 and the rack member 245 regulate a direction in which the key member 242 is moved to a vertical direction. The fixed end of the key member 242 is coupled to the free end of the second turning member 240 via the second coupling member 246.

The above key member 242 is provided to a supply selecting member 243 so that the key member can be touched to the supply selecting member. The supply selecting member 243 is fixed to the side of the carriage 3 and when the supply selecting member comes in contact with the key member 242, the supply selecting member moves the key member 242 sideways. Therefore, if the key member 242 does not come in contact with the supply selecting member 243 when the second turning member 240 is turned and the key member 242 is moved downward, the key member 242 and the fitting member 239 are not fitted and the first turning member 237 is not turned. In the meantime, as the key member 242 is turned, being moved sideways if the key member 242 comes in contact with the supply selecting member 243, the key member 242 and the fitting member 239 are fitted and the first turning member 237 is also turned.

The supply selecting member 243 is provided corresponding to each color, however, the arrangement pitch is different from the arrangement pitch of the ejecting mechanism 236. Therefore, if the carriage 3 is moved by controlling the carriage motor 8 and only the supply selecting member 243 corresponding to desired color comes in contact with the corresponding key member 242, only the first turning member 237 corresponding to the desired color is turned. Hereby, only the ink pellet corresponding to the desired color can be supplied to the corresponding melting tank 40.

Figure 8:
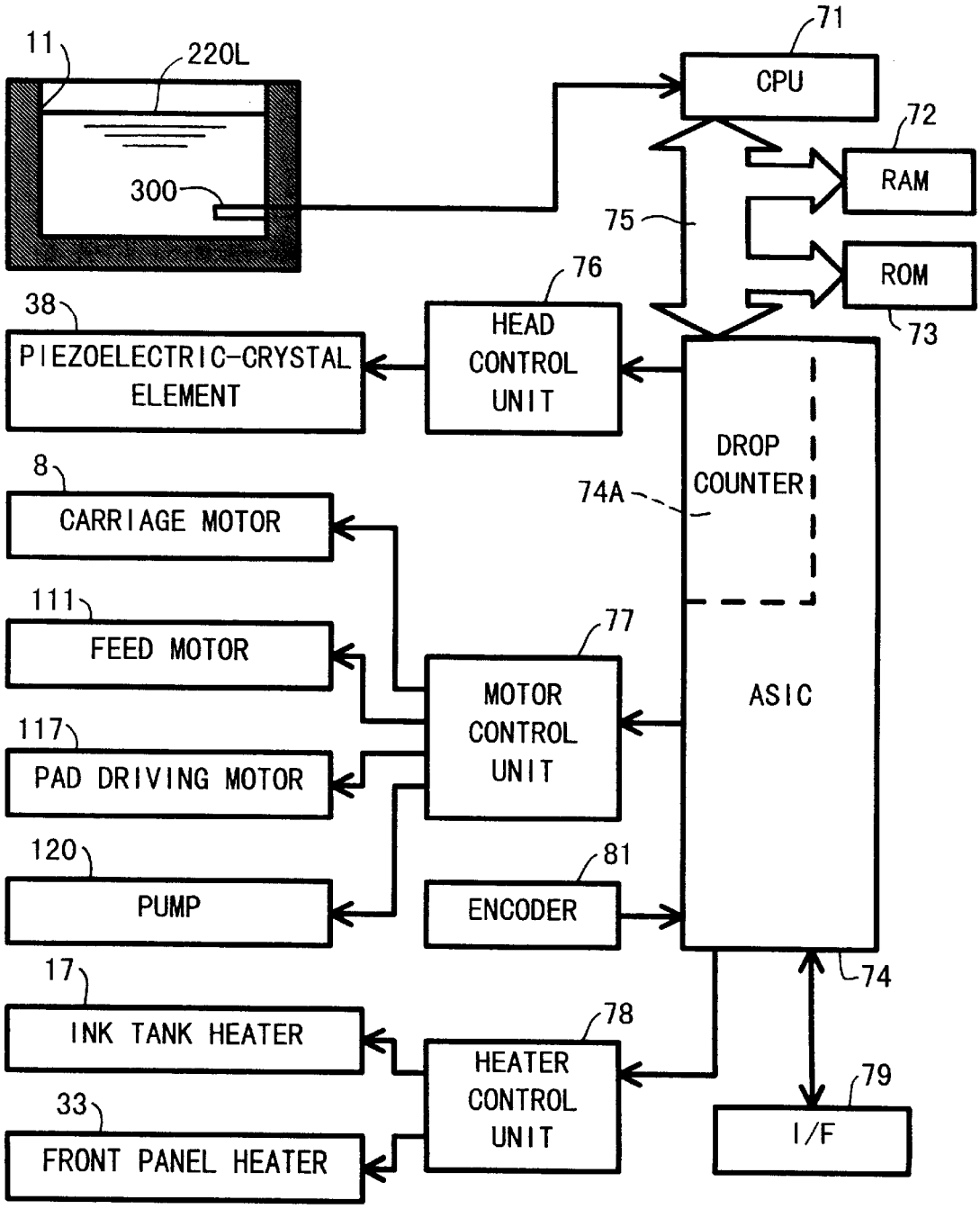
FIG. 8 shows the control board of the printer.

FIG. 8 is an explanatory drawing showing the configuration of the control board of the control panel stage 70. As shown in FIG. 8, the control board of the control panel stage 70 is structured by connecting CPU 71, RAM 72, ROM 73 and ASIC 74, via a bus 75. A head control unit 76 for driving the piezoelectric-crystal element 38 according to print data, and the like, the carriage motor 8, the feed motor 111, the pad driving motor 117, a motor control unit 77 for driving various motors, such as the pump 120, a heater control unit 78 for driving various heaters, such as the ink tank heater 17 and the front panel heater 33, an interface 79 for inputting or outputting data to/from an external personal computer, an encoder 81 for detecting a state in which the carriage motor 8 and others are rotated, and the like, are connected to ASIC 74. ASIC 74 comprises a well-known gate array and a drop counter 74A for driving the piezoelectric-crystal element 38 and for counting the number of jetted ink droplets every color.

Liquid ink 220L as a result of melting the ink pellet 220 is housed in the main chamber 11 and an ink sensor 300 for detecting that the ink 220L decreases and is required to be supplemented, is arranged in the main chamber 11. For the ink sensor 300, a thermistor may be arranged in the ink 220L and so that ink 220L is detected based upon the ease with which heat is taken when the thermistor is heated or the ink 220L may be detected based upon the state of conduction between a pair of electrodes arranged apart, to determine whether ink 220L exists. The ink sensor 300 outputs a detection signal to the CPU 71 corresponding to whether ink 220L decreases up to a quantity required to be supplemented (hereinafter called an ink supplement level).

Figure 9:
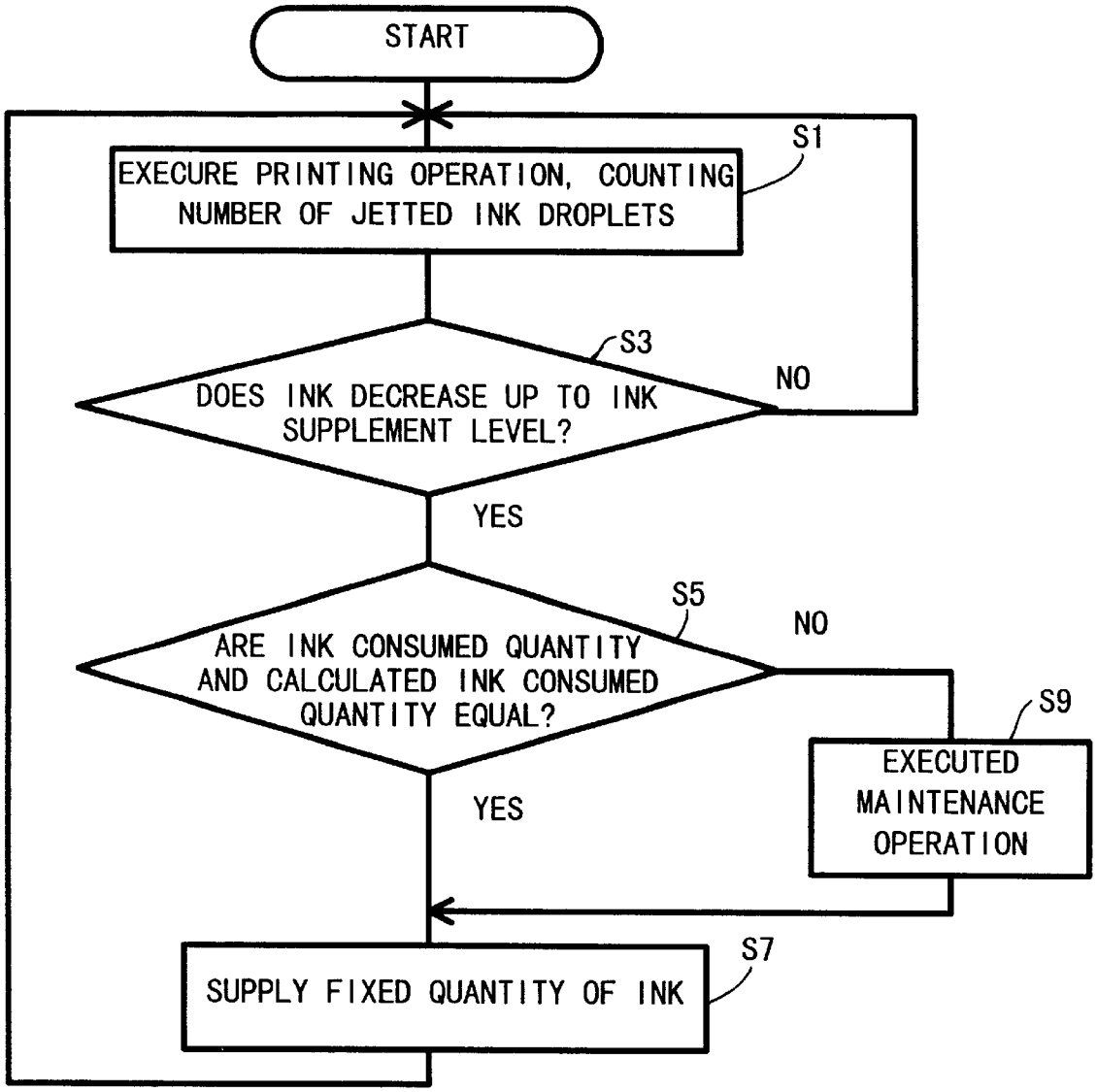
FIG. 9 is a flowchart showing processing executed by the CPU on the control board.

Next, processing executed by CPU 71 of the control panel stage 70 when print data, and the like, are input via the interface 79, will be described. FIG. 9 is a flowchart showing processing executed by the CPU 71. CPU 71 executes the above processing for every color when print data and the like, are input.

When the processing is started, first, processing proceeds to S1 (S represents a step) and the printing operation is executed, counting the number of jetted ink droplets by the drop counter 74A. As the printing operation is a well-known process, it is not described in detail. Processing proceeds to S3 every time the printing operation is executed and referring to a detection signal from the ink sensor 300, it is determined whether ink 220L decreases up to the ink supplement level. If ink does not decrease up to the ink supplement level (NO in S3), the printing operation in S1 is continued and if ink decreases (YES in S3), processing proceeds to S5. The number of jetted ink droplets counted by the drop counter 74A in S1 is counted as an accumulated value since the ink pellet 220 is supplied by the ink feeder 200. Therefore, if a power source is turned off while the process is in an executed loop in S1 and S3, the number of jetted ink droplets is immediately stored before the power source is turned off in a backup RAM (not shown) and the like. Thus, when the power source is turned on again, the drop counter starts to count from the next stored value.

Various times, for proceeding from S1 to S3 is devised as follows, and suitable times can be selected according to characteristics, such as resolution required for a printer and printing speed.

① Approximately in parallel with the printing operation, that is, during printing, the determination in S3 is normally made.

⓪ When the carriage 3 is moved to the vicinity of the end of recording paper by the printing operation in S1 (when one movement of the carriage is completed), the determination in S3 is made.

③ When the printing operation for one page in S1 is finished, the determination in S3 is made.

④ When the printing operation in one paragraph across plural pages in S1 is finished, the determination in S3 is made.

However, in the cases shown in ③ and ④, the position of the ink sensor 300 is required to be set so that all ink 220L is not consumed until the next page or paragraph is finished. Therefore, even when ink 220L decreases up to the ink supplement level, it is desirable that the quantity of ink for at least one page is secured.

The quantity of ink per ink droplet is normally set to an approximate fixed value (supposed the quantity of ink $\alpha$). The value $\alpha$ also depends upon resolution, is approximately 10 to 150 pl (picoliter=$10^{-12}$ l), in the case of 300 dpi, the value is approximately 80 pl, and in the case of 600 dpi, the value is approximately 40 pl. The quantity of ink per droplet varies by approximately ±10%. If the whole one page (A4, for example) is printed at the rate of 300 dpi (80 pl/dot), ink 220L equivalent to approximately 0.5 to 0.6 cc is consumed. As are equivalent to 10 to 20% is printed in the case of average text printing, the quantity of ink per page is approximately 0.05 to 0.12 cc per color.

Further, in the process, as described below, the maintenance operation in S9 may be executed before ink is supplied in S7. Therefore, the position of the ink sensor 300 may also be set so that the ink 220L (which is normally 0.1 to 0.3 cc and varies as the quantity of ink per ink droplet) required for purging, is secured even when it is determined in S3 that ink 220L decreases up to the ink supplement level (YES).

When ink 220L decreases up to the ink supplement level and processing proceeds to S5, the consumed quantity of ink and the calculated quantity of ink are compared as follows: If both are equal (YES in S5), one ink pellet 220 of corresponding color is supplied by the ink feeder 200 in S7 and processing proceeds to S1.

In this embodiment, every time ink 220L decreases up to the ink supplement level, one ink pellet 220 is supplied in S7. The consumed quantity of ink is equal to the supplied quantity of ink until the process proceeds to S5 again. That is, the consumed quantity of ink is equal to the quantity of ink (fixed quantity of approximately 3.0 cc) for one ink pellet 22.

The quantity of ink per droplet jetted from the nozzle face 36 is '$\alpha$', as described above if no ink jetting failure occurs. Therefore, the consumed quantity of ink 220L normally remains until processing proceeds to S5 again, at a value (the value is called calculated ink consumed quantity) obtained by multiplying the number of jetted droplets counted in S1 by '$\alpha$'. If the maintenance operation is executed until processing proceeds to S5 again (including during printing and when ink is supplied), a value obtained by adding the consumed quantity of ink 220L in purging is the calculated ink consumed quantity.

For a method of addition, the number of jetted droplets in purging may also be added by a value equivalent to the consumed quantity of ink. The consumed quantity of ink corresponding to the frequency of purging (stored in RAM 72) may be also added to the calculated ink consumed quantity calculated based upon the number of jetted droplets used by the printing operation. The quantity $\alpha$ of ink per droplet may vary depending upon color. For example, in the case of 300 dpi, the quantity of ink per black ink droplet may be set to 70 pl and the quantity of ink per yellow ink droplet may be set to 90 pl. In this case, the calculated ink consumed quantity used in S5 is calculated using '$\alpha$' of a corresponding color. Further, the quantity of ink for one ink pellet 220 may also vary depending upon color. For example, black ink pellet frequently used may be relatively large and therefore, the main chamber 11 may be also large. In this case, the supplied quantity of ink used in S5 is set according to the corresponding color.

As ink 220L decreases up to the ink supplement level when the process proceeds to S5, the consumed quantity of ink is normally equal to calculated ink consumed quantity (YES in S5). In this case, every time ink 220L decreases up to the ink supplement level (YES in S3), the ink pellet 220 is automatically supplied one by one in S7 and the printing operation in S1 according to print data and the like, can be automatically and continuously executed for a long period.

However, as ink is not jetted according to a driving signal (that is, the number of jetted ink droplets) from the piezoelectric-crystal element 38 when a failure of jetting ink occurs in the head 1, the ink consumed quantity and calculated ink consumed quantity are not equal. In this case (NO in S5), it is determined that an ink jetting failure has occurred in the head 1. After the maintenance operation is executed in S9, the process is returned to S7 and the ink pellet 220 is supplied.

In S5, it is not determined whether the ink consumed quantity and the calculated ink consumed quantity are strictly equal, but it is determined whether the difference between both is actually smaller than a predetermined quantity. For example, as described above, the quantity $\alpha$ of ink per ink droplet and the consumed quantity of ink in purging also vary and the detection precision and the characteristics of the ink sensor 300 also vary. The above predetermined quantity is set according to the dispersion of the consumed quantity of ink and the like, and the tolerance for a defect (that is, the tolerance for a jetting failure). For example, if strict detection is required, the above predetermined value is set to a value slightly larger than a value corresponding to the dispersion of the consumed quantity of ink, and the like. If high precision is required, an ink sensor 300 with a detection precision is used. Further, if the processing in S3 is executed at the time of the above ② to ④, ink 220L may be already smaller than the ink supplement level to some extent when an affirmative determination is made in S3. If the processing in S3 is executed at the above time, the above predetermined value is set to a further larger value to catch the decreased quantity.

The time for proceeding from S3 to S5 also varies as the above ① to ④. The decrease of ink 220L up to the ink supplement level (YES in S3) occurs during the printing operation and the maintenance operation. However, if the determination process as in S5 is executed during the printing and maintenance operations, there is a slightly questionable case. In such a case, it is desirable that the time in ② to ④ is set. Proceeding from S1 to S3 may be also executed at the time described in ① and proceeding from S3 to S5 may be also executed at the time described in ② to ④. Such processing is realized by storing the number of jetted ink droplets when an affirmative determination is made in S3 in RAM 72, and the like, reading the stored value in S5 and executing the above determination process.

Further, if processing from S1 to S3 and from S3 to S5 is also executed at the time described in the above ①, time for proceeding from S5 to S9, that is, the timing of executing the maintenance operation can be devised as follows: That is, if the maintenance operation is executed at the time described in ①, the printing operation is halted halfway, a printing situation at that time is stored, and the maintenance operation is executed. The time may be also set as described above, however, in this case, even if the printing operation is continued again based upon the stored printing situation after the maintenance operation, a joint may be formed in a printed image. In the ink-jet printer of the type that the carriage is moved (as in this embodiment), it is conceived that the maintenance operation in S9 is executed at the first paper feed time (for example in the above ②, after a negative determination in S5. Even in this case, the problem of a printing joint may occur. However, in the case of large paper printing and the like, there is also a benefit if it is conceived that the printing operation is halted halfway and the recording paper is discarded.

According to the printing operation, executing the maintenance operation in S9 after the printing operation is completed, and halting the printing operation halfway and executing the maintenance operation, may be also switched. For example, if recording paper is of specific paper size and the printing operation is executed at a half of the paper size or more, the maintenance operation may be also set so that it is executed after the printing operation on the page is finished. In addition, even if printing operation is executed at a half or more if the recording paper is of another paper size, the maintenance operation may be also set so that the printing operation is halted halfway and the maintenance operation is executed. Further, the timing of the maintenance operation varies depending upon a method of setting the above predetermined quantity related to the determination in S5. For example, if the predetermined quantity according to strict detection is set, (i.e., a slightly more predetermined quantity is set), an ink jetting failure seldom occurs even if a negative determination is made in S5. In this case, it is desirable that the maintenance operation is executed after the printing operation on the page being printed is completed.

Next, various types of maintenance operations in S9 are conceivable and for example, the following type can be adopted. That is, after purging occurs where the rubber pad 115 is pressed on the nozzle face 36 and the ink is circulated, the rubber pad 115 is separated from the nozzle face 36 and ink is discharged from the nozzle 32, and the carriage 3 is moved, the rubber pad 115 is pressed on the nozzle face 36 and ink on the nozzle face 36 is wiped. In the ink-jet printer, when an ink jetting failure occurs (NO in S5), the failure can be automatically solved by executing such a process. The maintenance operation in S9 may be also executed after ink is supplied in S7.

As described above, if the actual ink supplied quantity (=ink consumed quantity) corresponding to the quantity of ink for one ink pellet 220 and the calculated ink consumed quantity calculated based upon print data and the like, are compared, and difference between both is a predetermined quantity or more, the ink-jet printer equivalent to this embodiment determines that an ink jetting failure occurs in the head 1. Therefore, an ink jetting failure in the head 1 can be precisely and automatically detected. Therefore, even if a user fails to find an ink jetting failure, a large quantity of printing error can be satisfactorily prevented from occurring. In the ink-jet printer, as the maintenance operation is executed in S9 when an ink jetting failure occurs (NO in S5), the frequency with which the maintenance operation is executed can be set to the necessary minimum value. Therefore, the waste of ink and printing time can be satisfactorily prevented.

Further, in the ink-jet printer, it can be detected that the ink 220L equivalent to the above ink supplied quantity is consumed by an extremely simple structure where only an ink sensor 300 for detecting that ink 220L decreases up to the ink supplement level, is provided. Therefore, the structure of the ink-jet printer can be simplified and manufacturing costs can be satisfactorily reduced.

Figure 10:
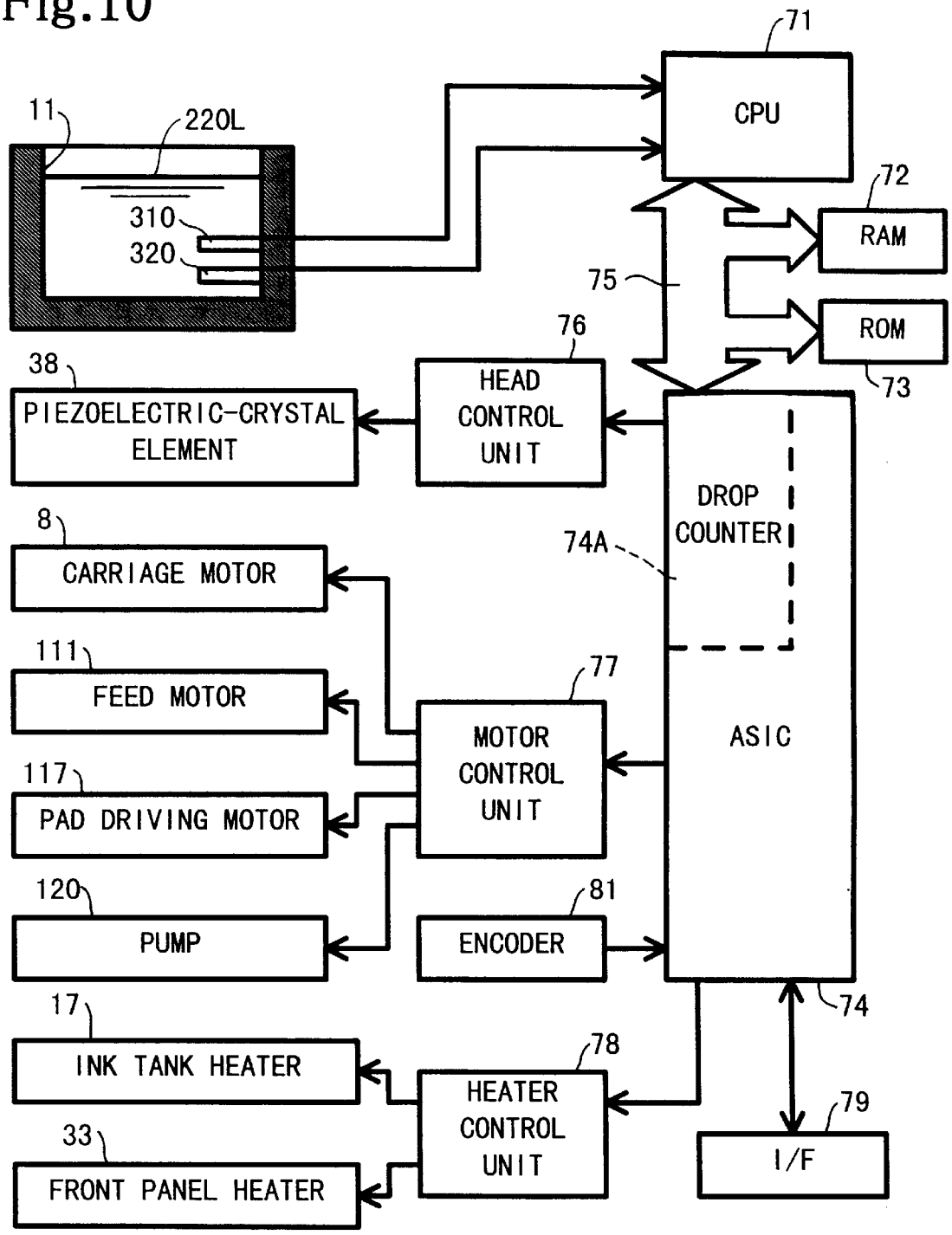
FIG. 10 shows the control board in a second embodiment.

Next, FIG. 10 is a drawing showing the configuration of a control board of a control panel stage 70 in a second embodiment of the present invention. The configuration of the control board in this embodiment is different from the configuration of the control board in the above embodiment according to the following description. Therefore, the differences in the configuration will be described, the reference numbers shown in FIG. 8 will be allocated according to the configuration above, and the detailed description of similar elements described above is omitted.

As shown in FIG. 10, in this embodiment, an ink sensor 310 for detecting that ink 220L in an ink tank 11 decreases up to a first reference value and an ink sensor 320 for detecting that the ink 220L decreases up to a second reference value smaller than the above first reference value, are provided in place of the above ink sensor 300. The ink sensors 310 and 320, respectively, output a detection signal to the CPU 71 corresponding to whether ink 220L decreased up to the first reference value or the second reference value. The above first reference value is set to a sufficiently smaller value than the quantity of ink obtained by melting one ink pellet 220 and the above second reference value is set to the quantity of ink approximately equal to the above ink supplement level.

Figure 11:
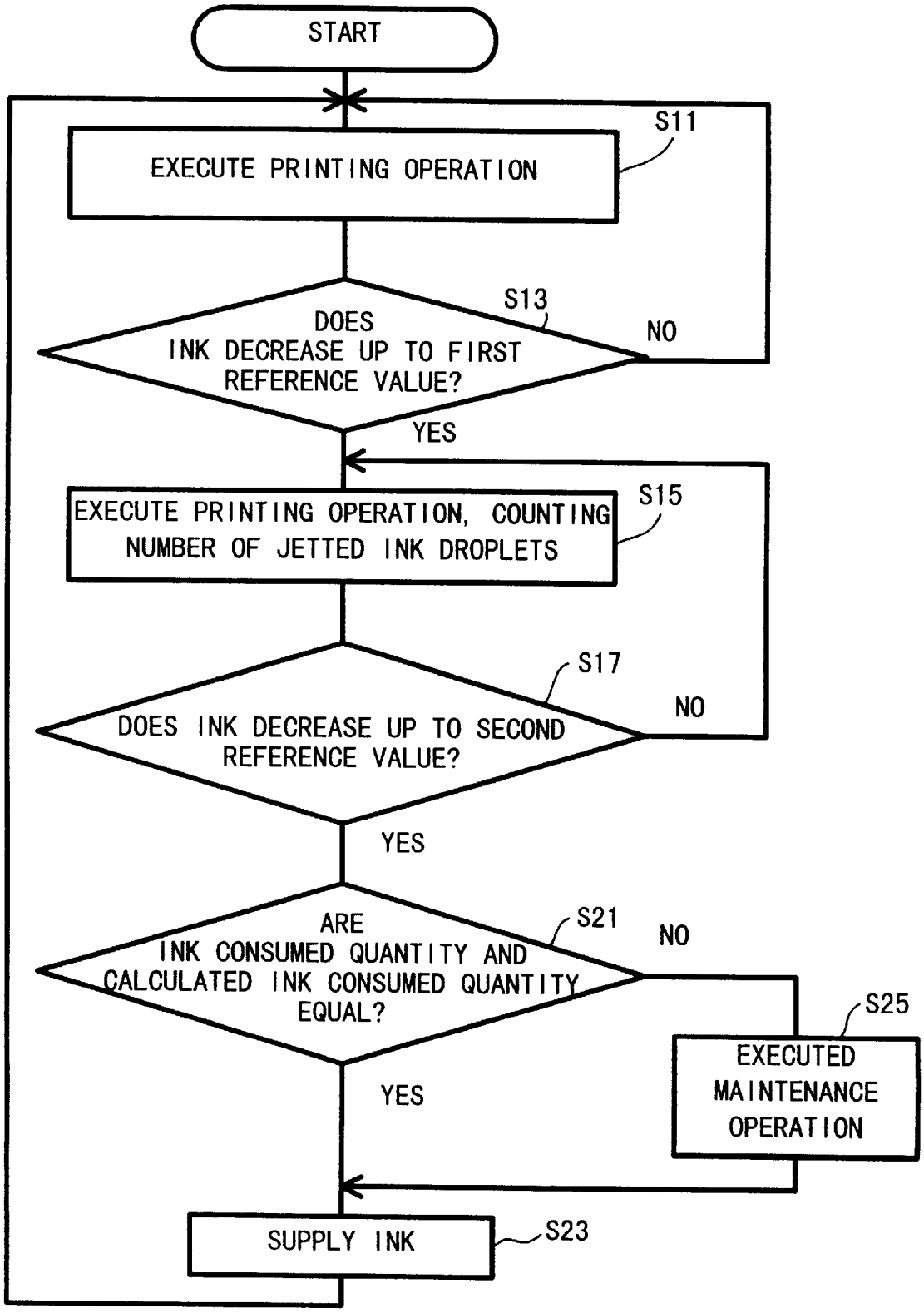
FIG. 11 is a flowchart showing processing executed by the CPU on the control board.

FIG. 11 is a flowchart showing processing executed by the CPU 71 in the second embodiment of the invention. In this embodiment, the CPU 71 also executes processing in parallel for every color when print data and the like, are input. Timing for proceeding through each step is also set approximately similar to that in the above embodiment.

When processing is started, first, the printing operation is executed in S11. The printing operation is different from the printing operation in the above S1 and is executed without counting the number of jetted ink droplets by a drop counter 74A. Processing proceeds to S13 every time the printing operation is executed and referring to a detection signal from the ink sensor 310, it is determined whether ink 220L decreases up to the first reference value. If the ink does not decrease up to the first reference value (NO in S13), the printing operation in S11 is continued and if the ink decreases (YES in S13), processing proceeds to S15.

In S15, counting the number of jetted ink droplets using the drop counter 74A since the number is the first reference value or smaller, the printing operation is executed as in the above S1. In S17, it is determined whether ink 220L decreases up to the second reference value and until the ink decreases up to the second reference value, the printing operation in S15 is continued. If the power source is turned off while the process is in a loop is executed in S15 and S17, the number of jetted ink droplets is stored immediately before the power source is turned off in a backup RAM (not shown) and the like. When the power source is turned on again, counting is executed from the next stored value.

When ink 220L decreases up to the second reference value (YES in S17), processing proceeds to S21 and the ink consumed quantity and the calculated ink consumed quantity, are compared. In processing in S21, the ink consumed quantity is the quantity of ink equivalent to the difference between the first reference value and the second reference value. The calculated ink consumed quantity is the quantity of ink corresponding to the number of jetted ink droplets counted in S15, that is, the quantity of ink corresponding to the number of jetted ink droplets while ink 220L decreases from the first reference value to the second reference value.

If the ink consumed quantity and the calculated ink consumed quantity are equal (YES in S21), it is determined that no ink jetting failure has occurred and after ink is supplied in S23, the printing operation in S11 is continued. If the ink consumed quantity and the calculated ink consumed quantity are not equal (NO in S2), it is determined that an ink jetting failure has occurred and after the maintenance operation is executed in S25, processing proceeds to S23.

In the second embodiment, as in the above embodiment, an ink jetting failure in the head 1 can also be precisely and automatically detected. Therefore, even if a user fails to find an ink jetting failure, a large quantity of printing error can be satisfactorily prevented from occurring. In the second embodiment, as the maintenance operation is also executed in S25 when an ink jetting failure occurs (NO in S21), the frequency with which the maintenance operation is executed can be set to the necessary minimum value. Therefore, the waste of ink and printing time can be extremely satisfactorily prevented. Further, in the second embodiment, the ink consumed quantity and the calculated ink consumed quantity are compared while ink 220L decreases from the first reference value to the second reference value. Therefore, the number of jetted ink droplets counted by the drop counter 74A corresponds to a relatively short period and the load related to counting the number of jetted ink droplets, such as the drop counter 74A and the memory capacity of the backup RAM, can be further reduced.

Also, in the second embodiment, as the ink consumed quantity is compared while the ink 220L decreases from the first reference value to the second reference value, the supplied quantity of ink in S23 may be also arbitrary. For example, an ink pellet of different shape from the ink pellet 220 may also be supplied. If all ink pellets 220 are removed from an ink feeder 200, processing in S23 cannot be executed and an error occurs. At this time, if an ink pellet different in shape is inserted into a melting tank 40 manually and CPU 71 is reset after it is melted, various ink pellets can be used. In such a case, in the second embodiment, it can be also satisfactorily detected based upon ink consumed quantity while ink decreases from the first reference value to the second reference value, and the like, whether an ink jetting failure occurs.

Figure 12:
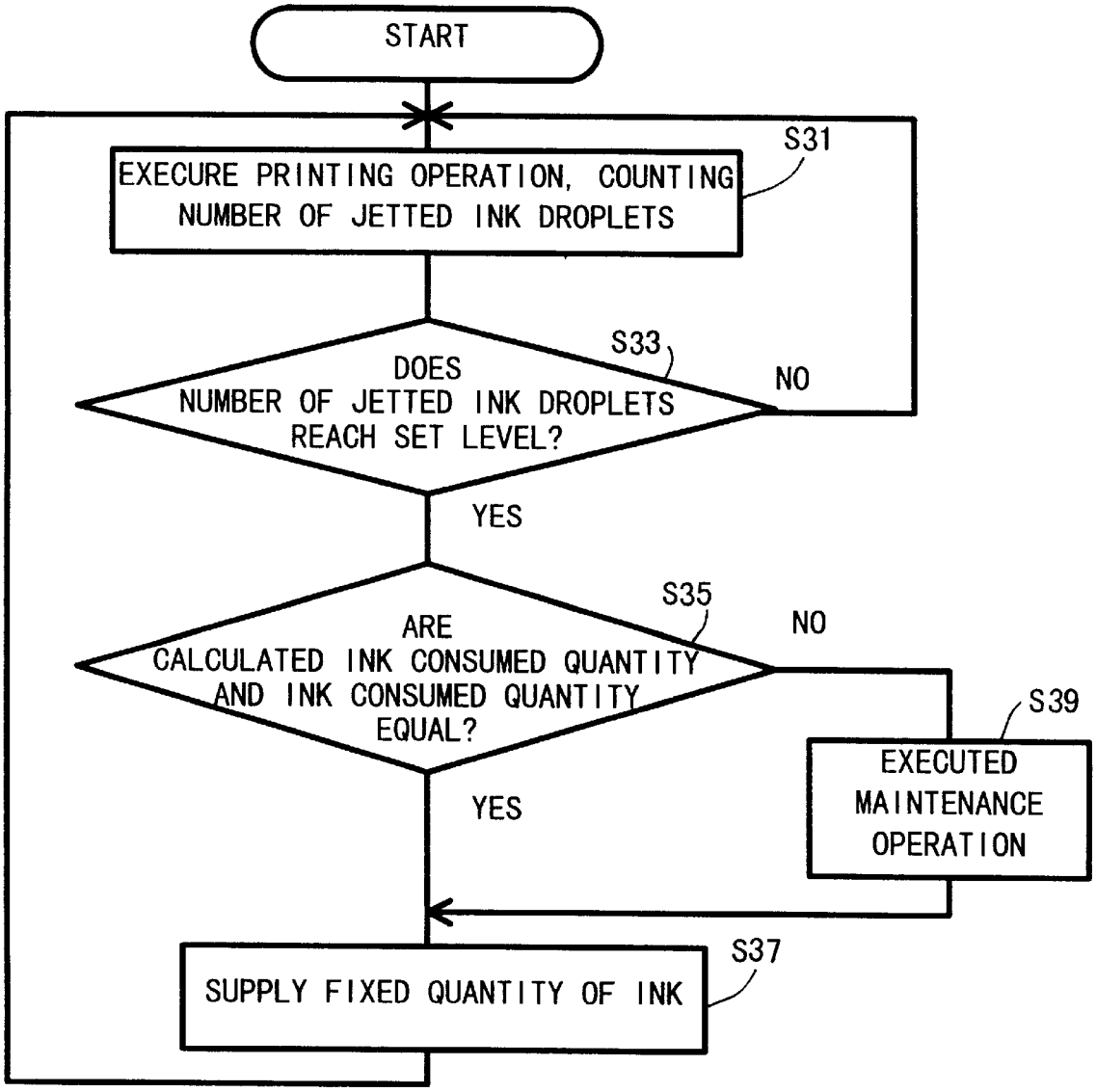
FIG. 12 is a flowchart showing processing executed by the CPU on the control board in a third embodiment.

Next, FIG. 12 is a flowchart showing processing executed by the CPU 71 in a third embodiment of the present invention. As the configuration of a control board of a control panel stage 70 in the third embodiment of the invention is the same as that in the above first embodiment shown in FIG. 8, the detailed description is omitted. In this embodiment, the CPU 71 also executes the parallel processing for every color when print data and others are input. Timing for proceeding to each step is also set approximately similar to that in the above embodiments.

As described above, as the quantity of ink per ink droplet is normally an approximately fixed value, the quantity in which ink 220L decreases up to an ink supplement level can be converted to the number of jetted ink droplets. In the first embodiment, a quantity in which ink decreases is detected by the sensor and is based upon the detection results, and processing proceeds to the step (S5) in which the ink consumed quantity and the calculated ink consumed quantity are compared. However, in the third embodiment, the number of jetted ink droplets required to supplement ink is preset, it is determined whether the number of jetted ink droplets reaches the set level and based upon the determination result, and processing proceeds to the step in which the ink consumed quantity and the calculated ink consumed quantity are compared.

When processing is started, first, the process proceeds to S31 and the printing operation is executed, and the number of jetted ink droplets are counted by a drop counter 74A. Every time the printing operation is executed, processing proceeds to S33 and referring to a value counted by the drop counter 74A, it is determined whether the number of jetted ink droplets reaches the set level. If the number does not reach the set level (NO in S33), the printing operation in S31 is continued and if the number reaches the set level (YES in S33), processing proceeds to S35.

When the number of jetted ink droplets reaches the set level and processing proceeds to S35, the ink consumed quantity and the calculated ink consumed quantity are compared, as described above. If both are equal (YES in S35), one ink pellet 220 of corresponding color is supplied by an ink feeder 200 in S37 and the processing is returned to S31.

As ink 220L normally decreases up to the ink supplement level when processing proceeds to S35, the calculated ink consumed quantity is equal to ink consumed quantity (YES in S35). In this case, every time the number of jetted ink droplets reaches the set level, in other words, ink 220L decreases up to the ink supplement level (YES in S33), an ink pellet 220 is automatically supplied one by one in S37, and the printing operation in S31 according to print data and the like, can be automatically and continuously executed for a long period.

However, as the jetting of ink according to a driving signal (that is, the number of jetted ink droplets) from a piezoelectric-crystal element 38 is not executed when an ink jetting failure occurs in the head 1, the calculated ink consumed quantity and the ink consumed quantity are not equal. In this case (NO in S35), after it is determined that an ink jetting failure occurs in the head 1 and the maintenance operation is executed in S39, processing is returned to S37 and an ink pellet 220 is supplied.

The present invention is not limited to the above embodiments and various embodiments may be made. For example, in the above embodiments, when an ink jetting failure occurs (NO in S5, S21 and S35), the maintenance operation is executed in S9, S25 and S39. However, the jetted quantity of ink executed by the print head unit 1, the driving time, and the like, from the last ink jetting failure are stored and the maintenance operation may be also executed at a time immediately before the jetted quantity, driving time, and the like, when the ink jetting failure occurs. In this case, the occurrence of the ink jetting failure can be prevented beforehand and the occurrence of a printing error can be more satisfactorily inhibited.

The maintenance operation is not automatically executed and the occurrence of an ink jetting failure may be only informed by an alarm, and the like. That is, the structure may be provided with a controller for halting the driving (the printing operation) of an ink-jet head when the determination unit determines that an ink jetting failure has occurred and an information unit for informing a user and the like, of the occurrence of the ink jetting failure. For the information unit, a process such as sending data showing that an error has occurred in the ink-jet printer to a personal computer via an interface 79 and the like, and instructing a printer driver to display a warning on the screen, may be provided. The user can execute the maintenance operation (that is, can specify suitable processing after he/she checks a state of an ink jetting failure) by sending a command via the printer driver, to the personal computer or operating a panel switch on the ink-jet printer, according to the warning. In an ink-jet printer which is not provided with a maintenance unit, the maintenance operation can be executed by a user according to the above warning.

Further, a detector for continuously detecting the quantity of ink 220L in a main chamber 11 is conceivable. For example, a pair of electrodes are provided in the vicinity of the lower part of the main chamber 11 and each variation of electrical resistance and electric capacity between both electrodes is detected (for example, the time constant of the response waveform of an applied pulse is detected), or a float may be floated in ink 220L and the height is detected, may be used. Thus, the above control can be started from any quantity of ink, such as the quantity of ink when purging is executed. Thus, when the ink 220L decreases by a predetermined quantity, the above stored quantity of ink and calculated ink consumed quantity, are compared. Therefore, in this case, an ink jetting failure can be more promptly detected.

If detection means which can continuously detect the quantity of ink is used as described above, an ink jetting failure can be determined by further various methods. For example, an ink jetting failure may also be determined by detecting the quantity of ink when the number of jetted ink droplets reaches a predetermined number, storing the quantity of ink in RAM 72, and acquiring the difference between the value and a result of the last detection (if the maintenance operation is executed, the consumed quantity at that time is also added). Also, a timer, (may be also in the ink-jet printer or may be also a timer which can be controlled by a printer driver in a personal computer) is provided and an ink jetting failure may also be determined based upon the difference between the quantity of ink after a predetermined time (may be also timed only during printing) elapses and the quantity of ink before predetermined time elapses (last time), and the number of jetted ink droplets, since the last time.

Further, for the maintenance unit, well-known various structures in addition to the above one can be also applied. Particularly, if the maintenance unit which can execute the maintenance operation for every color is applied, the maintenance operation in S9, S25 or S39 can be executed only for color corresponding to an ink jetting failure. In this case, the wasted ink can be satisfactorily saved. In the meantime, if the maintenance operation is executed for all colors when an ink jetting occurs as in the above embodiments, the maintenance operation can be prevented from being frequently executed and the printing speed can be enhanced.

What is claimed is:

1. An ink-jet printer, comprising:

an ink tank that stores ink;

an ink-jet head that jets ink in the ink tank onto a recorded medium according to a driving signal;

a detector that detects the consumed quantity of ink in the ink tank;

a calculation unit that calculates the consumed quantity of ink in the ink tank according to the driving signal; and a determination unit that, upon consumption of a predetermined amount of ink as determined by the detector, compares the ink consumed quantity calculated by the calculation unit and the ink consumed quantity detected by the detector, the determination unit determining that an ink jetting failure has occurred in the ink-jet head if a difference between the ink consumed quantity calculated by the calculation unit and the ink consumed quantity detected by the detector is greater than a predetermined quantity.

2. The ink-jet printer according to claim 1, further comprising:

a maintenance unit that cleans the ink jetted path of the ink-jet head; and a maintenance controller that executes cleaning by the maintenance unit when the determination unit determines that an ink jetting failure has occurred.

3. The ink-jet printer according to claim 1, wherein the detector detects at least a decrease of ink in the ink tank.

4. The ink-jet printer according to claim 3, wherein the detector detects when ink is required to be supplemented.

5. The ink-jet printer according to claim 1, wherein the detector detects at least that ink in the ink tank decreases up to a first reference value and that the ink decreases up to a second reference value different from the first reference value.

6. The ink-jet printer according to claim 5, wherein the calculation unit calculates the consumed quantity of ink after the detector detects that ink in the ink tank has decreased to the first reference value.

7. The ink-jet printer according to claim 1, wherein the calculation unit comprises a setting unit that sets a number of jetted ink droplets before ink is required to be supplemented.

8. The inkjet printer according to claim 7, wherein the determination unit determines that an ink jetting failure has occurred in the ink-jet head based upon the number of jetted ink droplets set by the setting unit.

9. The ink-jet printer according to claim 1, further comprising:

a ink supply unit that supplies a predetermined quantity of ink into the ink tank; and a supply controller that instructs the ink supply unit to supply ink when the determination unit determines that ink is required to be supplemented.

10. A method for operating an ink-jet printer, comprising:

jetting ink from an ink tank that stores ink onto a recorded medium according to a driving signal;

detecting the consumed quantity of ink in the ink tank;

calculating the consumed quantity of ink in the ink tank according to the driving signal;

comparing the ink consumed quantity calculated in the calculating step and the ink consumed quantity detected in the detecting step; and upon consumption of a predetermined quantity of ink, determining that an ink jetting failure has occurred in the ink-jet head if a difference between the ink consumed quantity calculated in the calculating step and the ink consumed quantity detected in the detecting step is greater than a predetermined quantity.

11. The method according to claim 10, further comprising:

cleaning the ink jetted path of the inkjet head; and controlling execution of cleaning when the determining step determines that an ink jetting failure has occurred.

12. The method according to claim 10, wherein the detecting step detects at least a decrease of ink in the ink tank.

13. The method according to claim 12, wherein the detecting step detects when ink is required to be supplemented.

14. The method according to claim 10, wherein the detecting step detects at least that ink in the ink tank decreases up to a first reference value and that the ink decreases up to a second reference value different from the first reference value.

15. The method according to claim 14, wherein the consumed quantity of ink is calculated in the calculation step after the detection step detects that ink in the ink tank has decreased to the first reference value.

16. The method according to claim 10, further comprising setting a number of jetted ink droplets before ink is required to be supplemented.

17. The method according to claim 16, wherein the determining step determines that an ink jetting failure has occurred in the ink-jet head based upon the number of jetted ink droplets set in the setting step.

18. The method according to claim 10, further comprising:

supplying a predetermined quantity of ink into the ink tank; and executing the supplying step when the determining step determines that ink is required to be supplemented.

19. A storage medium for storing programs for operating an ink-jet printer, comprising:

a program for jetting ink from an ink tank that stores ink onto a recorded medium according to a driving signal;

a program for detecting the consumed quantity of ink in the ink tank;

a program for calculating the consumed quantity of ink in the ink tank according to the driving signal;

a program for, upon consumption of a predetermined quantity of ink, comparing the ink consumed quantity calculated in the calculating program and the ink consumed quantity detected in the detecting program; and a program for determining that an ink jetting failure has occurred in the ink-jet head if a difference between the ink consumed quantity calculated in the calculating program and the ink consumed quantity detected in the detecting program is greater than a predetermined quantity.

* * * * *